United States Patent [19]

Ducote

[11] Patent Number: 5,000,634

[45] Date of Patent: Mar. 19, 1991

[54] LOW PROFILE EQUIPMENT/CARGO DECK CLAMP

[75] Inventor: John E. Ducote, Panama City Beach, Fla.

[73] Assignee: The United States of America as represented by the Secretary of the Navy, Washington, D.C.

[21] Appl. No.: 468,323

[22] Filed: Jan. 16, 1990

[51] Int. Cl.[5] ..... B63B 25/24

[52] U.S. Cl. ..... 410/77; 24/287; 24/683; 403/408.1; 410/84

[58] Field of Search ..... 410/52, 77, 80, 81, 410/82, 101, 117, 78, 84, 90; 248/500, 501, 503, 510; 24/287, 698.1, 698.2, 683, 295; 403/388, 408.1

[56] References Cited

U.S. PATENT DOCUMENTS

| | | | |
|---|---|---|---|
| 3,592,495 | 7/1971 | Fisher | 24/287 X |
| 4,129,395 | 12/1978 | Theurer | 410/81 X |
| 4,537,539 | 8/1985 | Borchart | 410/77 |
| 4,645,392 | 2/1987 | Takaguchi | 410/80 |
| 4,768,906 | 9/1988 | Gerhard | 248/500 |

*Primary Examiner*—Robert J. Oberleitner
*Assistant Examiner*—Craig Slavin
*Attorney, Agent, or Firm*—John Becker

[57] ABSTRACT

A low profile deck clamp and cargo or deck equipment anchoring system which utilizes a removable, keyed deck clamp in association with equipment or cargo entity-provided attachment flanges, and also with pre-existing deck sockets formerly used with other known prior art tie-down systems. The clamp in a more preferred form has a horizontal planar slotted body member disposed above deck, and a double offset unique key portion which downwardly depends from its forward end as a generally below-deck portion. Attachment flanges are initially or subsequently formed to the base of each cargo or equipment entity. An angular form of attachment flange with a planar base portion disposed parallel upon the deck, is provided with adjacently disposed key-passable clearance holes and a plurality of strategically placed threaded holes to manually and collectively cooperate with the deck sockets, the clamp's keyed portion and a plurality of anchoring bolts passing through the slots of the clamp's planar body member. In an alternate embodiment in which the below deck key portion is essentially the same, the above deck body portion is non planar, upright and rectangular in form with transverse mounting apertures through the opposed flat vertical faces, for bolting directly to cargo or equipment items having only vertically disposed attachment flanges engaging the deck. Both forms aptly provide a low profile cargo securing system in lieu of more space consuming cable tie down systems of the prior art.

16 Claims, 3 Drawing Sheets

LOW PROFILE EQUIPMENT/CARGO DECK CLAMP

GOVERNMENT INTEREST STATEMENT

The invention described herein may be manufactured and used by and for the U.S. Government for governmental purposes without the payment of any royalties thereon or therefor.

BACKGROUND AND FIELD OF INVENTION

The present invention relates generally to cargo anchoring means or to tie down apparatus of a type used to secure equipment and cargo on board ships and/or other mobile transporting vehicles. The invention more specifically relates to an improved low profile tie down clamp apparatus for temporarily securing various equipment such as winches, generators, fuel tanks, and platforms to the open deck of various marine and air cushion vehicles such as the Navy's Landing Craft Air Cushioned Vehicles (LCAC). Many of the latter have decks which have been provided with series of circular deck sockets used with certain other prior art cable tie-down systems.

These various tie down or clamp installations are not intended to be of permanent character, and should not require any temporary welding or any drilling through or other altering or damage to the craft's structure in any manner.

PRIOR ART AND OBJECTS OF THE INVENTION

One existing tie down assembly which has been in use by the Navy is identified in a NAVSEA drawing number 673-575-0334 Revision B, and will be briefly described. It includes a type of fitting adapted to plug into a preformed deck socket, the fitting having an over-center tensioning device connected with a tie-down cable which can be looped around or otherwise fastened to the cargo or equipment being transported or in temporary use on the craft's deck. While this prior art system has performed reasonably well in certain situations for some types of cargo or equipment, certain inherent disadvantage of that system remain, such as being too space consuming and bulky in that the various sets of tie-down cables obstruct large areas of the deck and hamper movement of personnel and gear. This prior art system also only allows the equipment to be secured in the more central areas of the deck because of the necessity to tie it down from at least two opposite sides of the equipment. A further disadvantage is that its engagement portion or section can only resist a pull in the direction of its tie down cable or cables with the result that pushing in the cable-aligned direction or exerting an oblique or cross-directed force will tend to release the prior art tensioning device from the deck socket.

Accordingly, it is a primary object of the present invention to provide a novel equipment securing deck clamp device which will secure the equipment to the deck with minimum obstruction of the deck area adjacent to the equipment.

It is another object to provide a low profile deck clamp device and system which can utilize the existing system's deck sockets, and which system includes apertured base flange means which are either vertically or horizontally disposed as part of the equipment's base or have been added thereto for attaching it directly to the deck and deck sockets. One prior arrangement of preexisting deck sockets includes plural series of 1 ½" diameter holes or sockets spaced approximately thirteen inches apart along predetermined areas of the vessel's decks. For some cargo or equipment entities angle iron base feet or brackets have been added as attachment means.

Still a further object is to provide an improved clamp means of the aforesaid character which will prevent shifting of the cargo or equipment in any direction. This is because the new deck clamp is prevented from rotating within the socket due to a combination of the unique design of the clamp's key member portion, together with complemental attachment means to accommodate at least one and preferably a plurality of removable anchor bolts associated with it and the cargo unit's respective initially provided aperture attachment flanges.

Yet another object is to provide such an improved deck clamp and method of use which doesn't require any altering of craft and can be left in place as long as desired.

BRIEF SUMMARY OF THE INVENTION

This novel deck clamp is of rigid preferably metal or other suitably strong material, and consists of two basic parts. One is an above-deck portion which in a more preferred form constitutes a planar form base member having a pair of bolt—receivable slots. The other basic part is a generally below-deck portion in the form of an offset key member which is dependingly attached to one end of the base member and is uniquely formed with a pair of vertically offset and oppositely facing arcuate surfaces to snugly mate within the deck socket. It is also provided with a forwardly projecting lowermost nose tab. This tab lockingly engages beneath the vehicle's surface deck when in the assembled securing condition, after first passing through the correspondingly apertured horizontal portion of suitable attachment plates or flanges which are initially provided along the base edge of each cargo item or piece of equipment to be secured. Suitable hold-down bolts pass through the clamp's slotted base member and are mated with threaded apertures in each underlying attachment flange to complete securement of the deck clamp and cargo item in the installed condition.

The aforementioned objects, advantages, and details of two preferred embodiments will become more apparent from the following more specific description, when considered in conjunction with the accompanying illustrative drawings.

DETAILED DESCRIPTION OF A MORE PREFERRED EMBODIMENT

Figure 1:
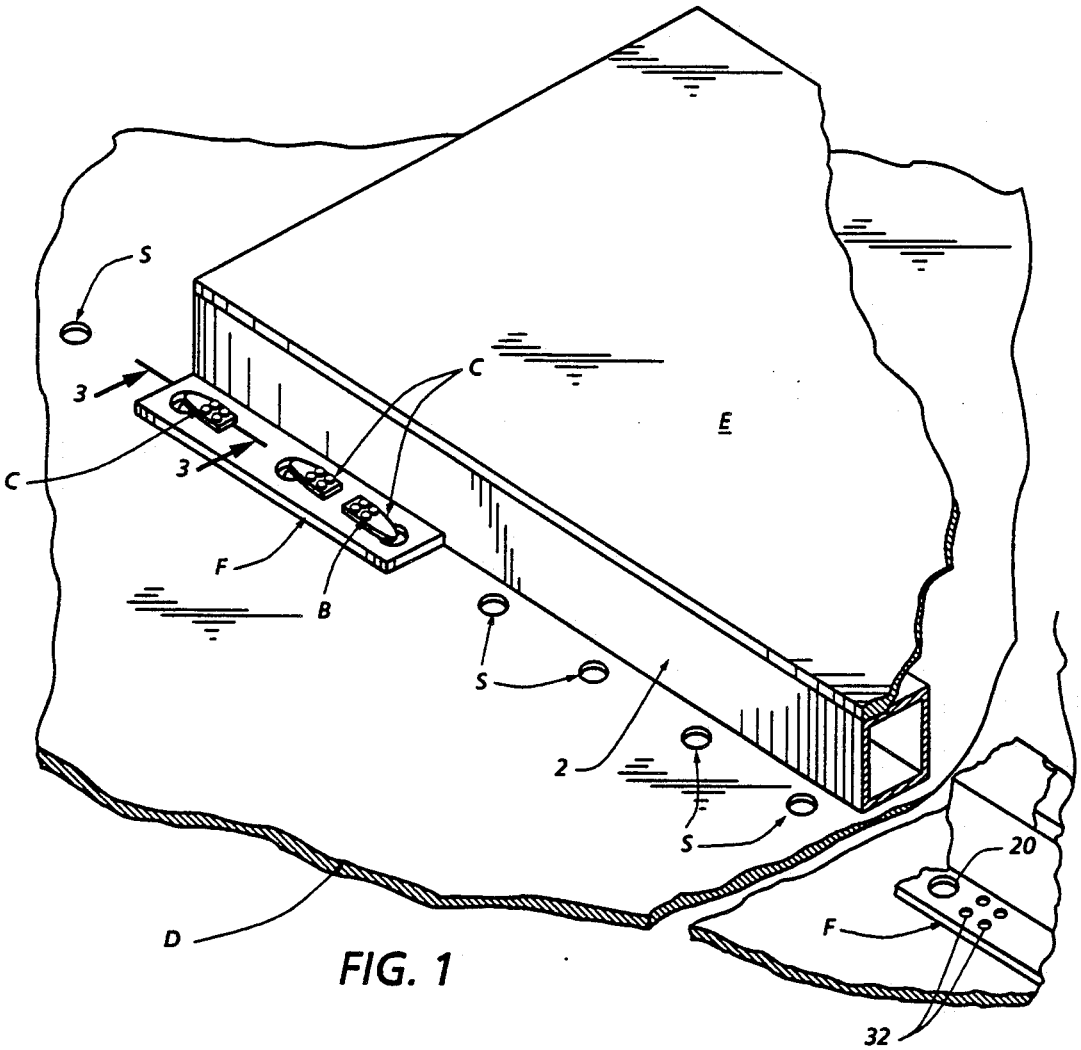
FIG. 1 is a fragmentary perspective view of a deck onto which a piece of equipment or cargo item having suitable attachment flange means is shown secured by means of my new deck clamp.

Referring generally to FIG. 1, the new clamps C are shown in an assembled relationship with preexisting deck sockets S via clearance holes 20 provided in each of a plurality of rigid attachment flanges F. The existing deck sockets S heretofore have been used in conjunction with other prior art securing apparatus. L-shaped brackets or flanges F are initially provided on the lower edges of each piece of equipment E to be secured to the vessel or vehicle deck D via the clamp C and its plurality of fastening bolts B. These novel deck clamps may be fabricated of high strength aluminum, stainless steel, carbon steel, or various alloys thereof.

Figure 2:
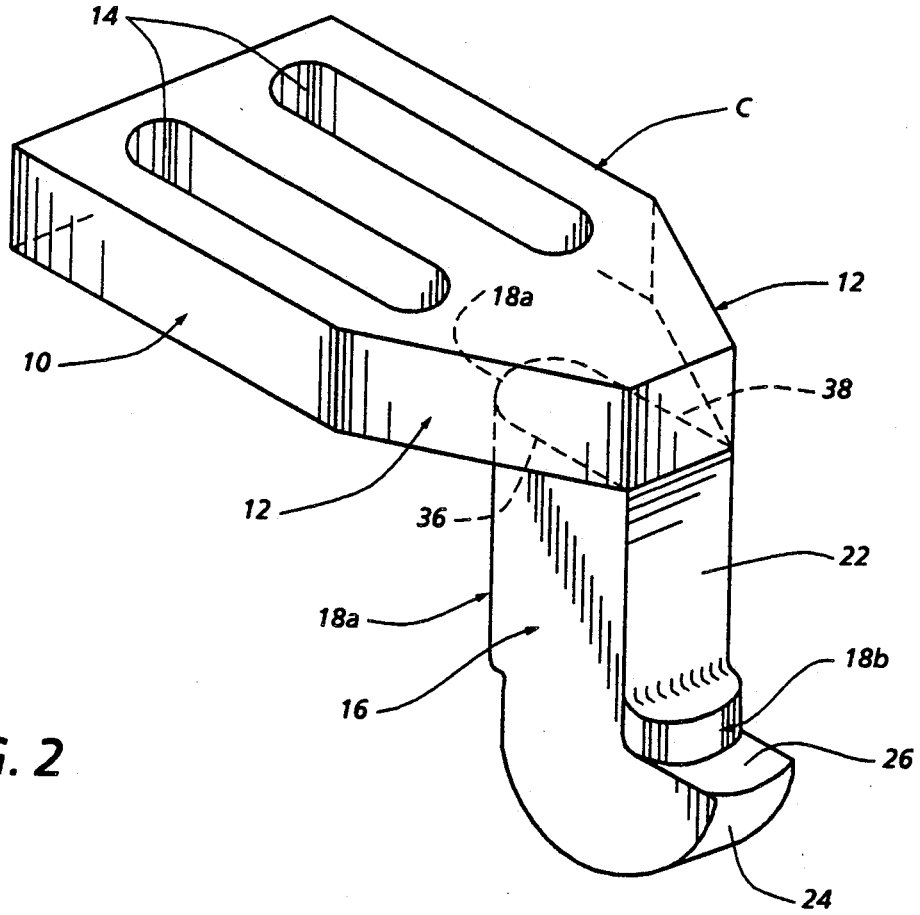
FIG. 2 is an enlarged frontal perspective view of the more preferred form of my new deck clamp.
Figure 3:
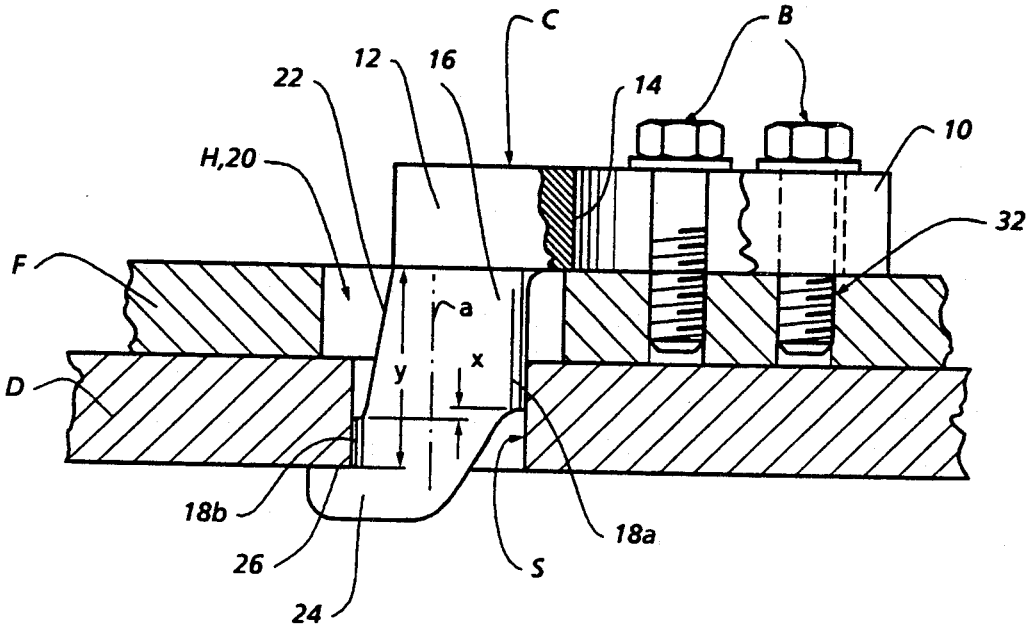
FIG. 3 is a longitudinal partial cross-sectional view and partial elevational view of the more preferred assembly as viewed on line 3—3 of FIG. 1.
Figure 4:
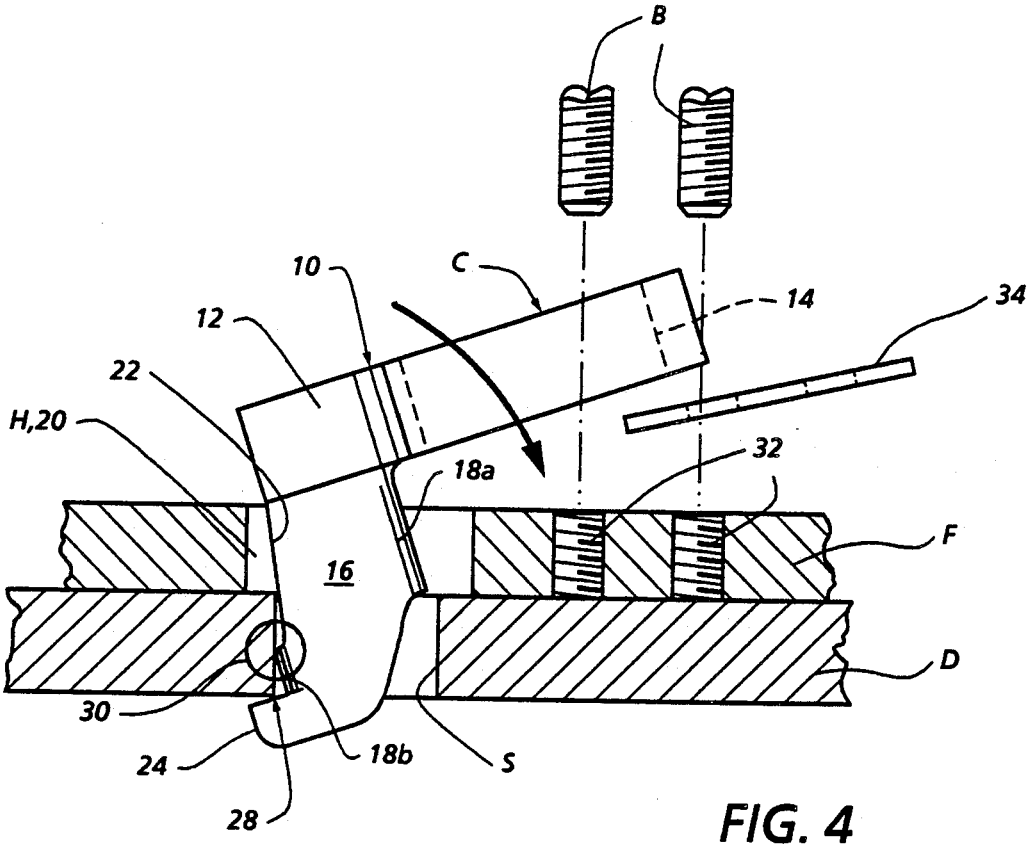
FIG. 4 is a view similar to FIG. 3 but showing the deck clamp of FIG. 2 in full side elevational view in the process of being inserted into complementary association with the deck socket.

More specifically referring to FIGS. 2–4, in which like reference characters refer to like parts throughout the several figures, the above-deck portion of clamp C comprises a first basic part in the form of a planar body portion 10 which preferably has a partially tapered forward end 12. The planar body portion 10 is provided with at least one and preferably a pair of elongated apertures or parallel slots 14, 14 which extend approximately two thirds the length of body 10 preferably in the fore-aft direction, and which slots terminate forwardly at about the beginning of the tapered portion 12. For some applications or as a modification, a fastener receiver slot may be disposed laterally or transversely to those shown.

Projecting downwardly from the forward tapered portion 12 is the second basic part, the generally below-deck portion, in the form of a double offset key member 16, having two vertically offset and oppositely facing arcuate surfaces. The first is a rearwardly facing surface **18*a* which extends downwardly perpendicular from planar body 10. Its downward length is sufficient to extend through an enlarged clearance hole H of the attachment flange F, and a substantial distance into the existing deck socket S, in a close fitting relationship therein. The second arcuate surface is 18*b*; it faces forwardly and should be of an extent to fully engage substantially the remaining amount of the socket wall. As shown, it is of lesser downward length than 18*a* but sufficient to fully snugly engage the opposite lower remaining wall portion of said deck socket S. Both arcuate portions 18*a*, 18*b* have the same radius of curvature formed about a common axis designated a in key member 16, and are perpendicular to the plane of body member 10. The said curvature radius corresponds essentially to that of the diameter of the preexisting deck sockets S, but does not exceed that diameter. The axis a is perpendicular to the major plane of the clamp's above-deck base or body portion 10**.

The slightly inclined forward wall 22 of key member 16 is better observed in FIGS. 3 and 4, as is the slight vertical spacing x, which may be from about 0.02–0.06", which is provided between the lowermost edge of the upper curved surface **18*a* and the uppermost edge of the lower curved surface 18*b*. This difference will be such as to assure an entry clearance for the heel portion, i.e., for the lowermost edge of arcuate portion 18*a*, during the insertion of the clamp into the socket. This spacing x should be minimized so as to retain as much collective arcuate surface as possible for the two offset surfaces 18*a*, 18*b* to provide the maximum arcuate load engagement surface with the side wall of the socket S. The relative vertical extent of these respective surfaces 18*a*, 18*b*** can be varied to meet predeterminable variable directional loads according to the type of ship or vessel upon which the equipment is installed and depending upon the type of environment in which it will operate.

The lower end of key member 16, commencing at the lower edge of curved portion **18*a*, is tapered or inclined forwardly and downwardly and terminates in a lowermost forwardly projecting nose tab 24. Nose tab 24 has a flat upper surface 26 adapted to engage the adjacent flat underside of the vessel's deck D. The distance from the underside of the clamp's planar body member 10 to this flat surface 26 is indicated by the reference character y in FIG. 3. This distance y should closely total the combined thicknesses of deck D and the attachment flange F. In the event of significant thickness variation in either or both of D and F, some of the clamps C can be made with greater or lesser y distances. Where a clamp with an excessive y distance needs to be used, this excess spacing can be generally reduced by insertion of an appropriate type and thickness shim element 34, FIG. 4, between the above deck clamp body portion 10** and the flange F.

The aforestated tapered character of the key member 16 is so designed only to provide the required upper clearance for the key to be inserted in the forwardly inclined manner depicted in FIG. 4. This shape maximizes the key shank's lower thickness for added strength. However, a clamp without the tapered front wall 22 may be desired for some situations. Although the arcuate rear portion **18*a* is shown as extending starting from beneath planar body 10 fully down to its lower edge, it need only be of the described arcuate form in that area which is adapted to engage in the socket S. Thus these front and back walls may be made parallel for at least part of their length. The key 16 is preferably provided with parallel opposite lateral sides 36 and 38, better seen in FIG. 2**.

OPERATION OF THE CLAMP

With continuing reference to FIG. 4, the low profile deck clamp C is installed by inclining the forward key end downwardly as shown. After the key 16 passes through the clearance hole 20 of the preformed and/or preattached attachment flanges F of the cargo or equipment member E, the key member's lower projecting nose tab 24 is engaged beneath the lower edge 28 of the deck socket S, as shown. Simultaneously, the upper edge of the frontal arcuate portion **18*b* is engaged with the wall of socket S as indicated at 30, and then clamp C via its planar body or base portion 10 is rotated downwardly so that it pivots generally about the engagement point 30 until it becomes seated upon the attachment flange F, whereupon the surface 26 of nose tab 24** abuts against the underside of deck member D.

The aforesaid seating of the clamp body 10 is such that the slots 14, 14 are alignable over the strategically placed pairs of threaded apertures 32,32 provided in each of the attachment flanges F. Said apertures are clearly depicted in the lower right hand portion of FIG. 1. Each of the attachment flanges F is preferably provided with a plurality of two or more sets of the key clearance hole 20 and the related bolt-fastening holes 32,32. The slots 14,14 allow for a certain degree of clamp and mounting bolt relative adjustment to facilitate the attachment. A suitable plurality of bolts B, preferably four, are provided as shown for each clamp, although for some uses one or two fastener bolts may suffice. Bolts B are threaded into the holes 32 to rigidly secure the equipment article E to the deck. Due to the unique design of my deck clamp, when in the bolted down condition it is prevented from turning or rotating by the combined action of said bolts and the key's arcuate surfaces 18*a*, 18*b* engaged against each socket's side wall, and the key member's engaged nose tab 24 which prevents the clamp from being pulled out.

ALTERNATE EMBODIMENT

Figure 6:
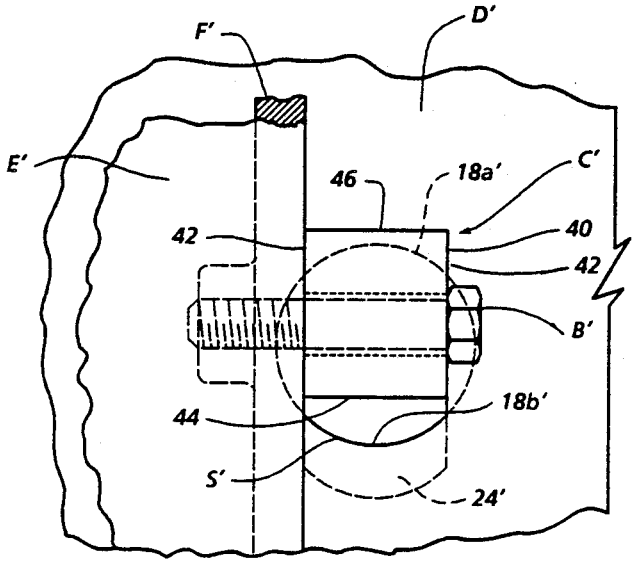
FIG. 6 is a top plan view of the latter embodiment shown in assembled anchoring condition with one fragmentary side of a cargo item.
Figure 5:
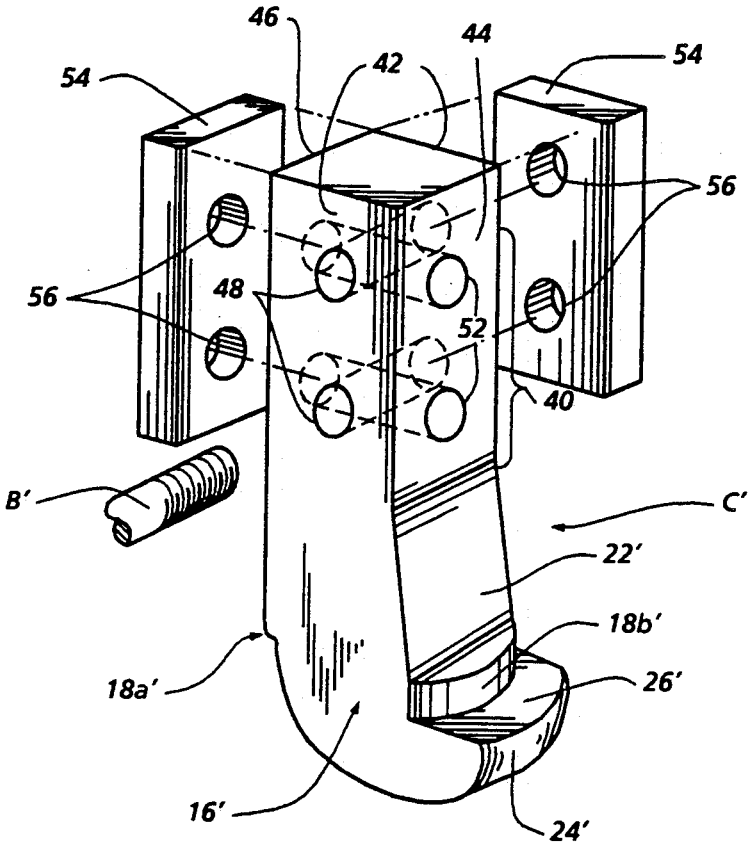
FIG. 5 is an enlarged frontal perspective view of another preferred embodiment of the deck clamp.

Reference is now made to FIGS. 5 and 6 which are representative of a suitable modified embodiment of the clamp. Primed reference characters will be used to denote those component parts which are common to it and the first described embodiment. The clamp is designated generally as C' and its below-deck key portion 16' is substantially identical to the key portion 16 of the FIG. 2 embodiment. Therefore the common parts identified by the same but primed reference characters need not be redescribed for this part of the description.

The above-deck body portion is denoted by the reference numeral 40 and is of preferably a square or rectangular upright form. This upper body portion 40 has its flat pair of laterally opposed sides designated 42,42, which may be generally coextensive with the aforesaid lateral sides 36 and 38 of the first embodiment key 16. The other fore and aft parallel faces of body portion 40 are designated 44 and 46. At least one and preferably a pair of fastener bolt-receivable apertures 48, are disposed in parallel fashion transversely extending between the lateral sides 42,42. Bolts B' are adapted to secure this upper body portion 40 to a cargo unit or equipment item E' which does not have the angular and horizontal attachment flanges F, but is provided only with vertically disposed wall portions to constitute attachment flange F', as per FIG. 6. The threaded shanks of the bolts are threaded into correspondingly threaded portions of the vertical flange wall or into threaded nut portions 50 which may be welded or otherwise suitable formed or attached in conjunction with a correspondingly apertured portion of flange F'.

The fore and aft walls 44 and 46 are also transversely apertured with similar apertures 52 which may be drilled at the same level as and intersect with the apertures 48. Thus, the transverse apertures 48, 52 and the squared faces or sides 42, 44, and 46 of upright body portion 40 facilitate the securing of such equipment items along any side of a vertically disposed base wall portion which has been or can be readily provided with fastener-receivable apertures to constitute a suitable attachment flange means such as that designated F'.

In the event it is desired to or necessary for the equipment or cargo item to be slightly spaced from where the deck socket S is positioned, or where some of the sockets may not have been initially positioned in the optimum location, it is contemplated to provide various thickness spacer plates, such as designated 54, FIG. 5, which have corresponding located clearance apertures 56. These spacer plates will provide the necessary proper spacing or alignment to assure secure non-oblique anchoring by the clamps C' with the base of the item E', as long as the clamp is inserted within the socket with one of the upper portions flat faces disposed for co-planar engagement with the equipment item's attachment flange F'. In some instances clamps C' may be fabricated with integrally formed spacer block areas on its opposed upper planar faces.

Accordingly, it is apparent that novel deck clamp means and a related cargo securing method have been developed which achieve all of the objectives and advantages heretofore mentioned. In addition to fabricating the deck clamp and attachment flanges from various high strength metals or metal alloys, it is contemplated that at least each of types of the deck clamps can be fabricated from other suitably reinforced or other high strength plastic materials. The clamp can be fabricated by machining, casting or molding depending upon the material, required number of units, and availability of materials and fabricating facilities.

While two specific preferred embodiment have been illustrated and described in some detail, which have been designed primarily for use on decks of air cushion vehicles such as the Navy's aforementioned LCAC, together with their associated method, it is recognized that other embodiments, modifications and applicational uses will readily come to mind of one skilled in the art and having the benefit of the teachings presented herein. Accordingly the invention is not intended to be limited to these specific embodiments, or method, because various other modifications and embodiments, such as an adjustable length key, may be made without departing from the spirit and scope of the invention as defined in the appended claims.

What is claimed is:

1. A low profile deck clamp apparatus for removably securing individual cargo and equipment entities to a deck surface of a transporting vehicle whose decks have preexisting series of at least generally uniformly spaced and uniformly sized circular anchoring sockets, and wherein said cargo and equipment entities have been initially provided with suitable base attachment flange means provided with predetermined aperture means for cooperative attachment with said deck clamp apparatus, said deck clamp apparatus comprising:

(a) a generally unitary deck clamp having a first body portion constituting an above-deck body portion of predetermined form provided with at least one aperture for accommodating attachment fastener means;

(b) a second body portion constituting a below-deck key member which extends downwardly from said first body portion;

(c) said key member having two vertically disposed and vertically offset arcuate surfaces circumscribed about a common vertical axis which is common to the axis of said anchoring socket, each of which radius of curvature corresponds substantially to that of but does not exceed the radius of curvature of said preformed circular anchoring sockets into which said clamps are operatively connected; and (d) said key member terminating in a downwardly and axially offset projecting nose tab adaptable for engagement beneath said vehicle's deck surface when said clamp is in an installed condition.

2. The deck clamp apparatus of claim 1, wherein said key member's vertically offset arcuate surfaces are disposed in opposite directions, and are of predetermined axial extent as to substantially fully and snugly engage the deck socket's side walls for their given arcuate extent.

3. The clamp of claim 2 wherein said axially offset nose tab of said key member is in general alignment with both of said oppositely offset arcuate surfaces.

4. The clamp apparatus of claim 1, wherein said vertical offset of said arcuate surfaces is a predetermined minimal amount of from about 0.02 to about 0.06 inch for installation tolerance clearance of a lower rearward edge portion of said key member during its inclination and insertion into said socket.

5. The clamp apparatus of claim 4, wherein for a known deck thickness and for known predeterminable directional loads, said two arcuate surfaces adapted for engagement with the side walls of said socket are of predetermined different but substantially complemental axial extent ranging respectively from between about 20 to about 80 percent of said known deck thickness, minus said vertical offset tolerance, so as to provide for their cumulative concurrent engagement with approximately all of the deck socket wall thickness.

6. The clamp apparatus of claim 1, wherein said above-deck body portion and said below-deck key member have portions which are angularly offset from one another.

7. The clamp apparatus of claim 1, wherein said above-deck body portion is laterally elongated and has an extended lower planar surface, and is angularly offset at a generally right angle from said below-deck key member, said laterally elongated portion having attachment aperture means and is adapted for overlying engagement with a generally horizontal deck-engagable flange member constituting part of said preamble-recited cargo and equipment base attachment flange means.

8. The clamp apparatus of claim 7, wherein said key member is disposed at and unitarily depends from one end of said laterally elongated body portion, and said above-deck body portion includes a dual slotted planar body, which slots are adapted to align with the preamble-recited aperture means provided initially in said cargo and equipment entities, and said slots further adapted to receive attachment fastener means therethrough to effect secure tie down or anchoring of said cargo or equipment entity.

9. The clamp of claim 7, wherein the length of said below deck key member, as measured from said lower planar surface of said above-deck laterally elongated body portion down to a top surface of said key's nose tab, is the approximate combined thickness of the said deck and base attachment flange of said cargo and equipment entity.

10. The clamp apparatus of claim 1, wherein said above-deck body portion is laterally elongated and offset from said key member, and includes a planar portion having two parallel elongated fastener-receivable apertures, said parallel apertures extending in the laterally elongated direction and are spaced apart to coincide with the preamble-recited aperture means in the apertured attachment flanges of the cargo and equipment entities to be secured to said deck.

11. The clamp of claim 10, wherein said key member's vertical axis about which both arcuate surfaces are circumscribed, is perpendicular, as are said vertical arcuate surfaces, to the plane of said above-deck body portion's planar portion and to the axis of said deck socket.

12. The clamp of claim 1, wherein said above-deck body portion is of upright form having at least two vertical flat surfaces disposed at about 90° C. relative to one another and adapted to be disposed also at about 90° C. relative to the vehicle's deck, and a pair of attachment-fastener apertures provided in said upright formed body portion and extending completely therethrough with at least one such aperture disposed in a transverse direction generally perpendicular to each of said 90° C. disposed flat surfaces, said apertures adapted to be aligned with corresponding fastener-receivable apertures initially provided in said equipment's base attachment flange means, and to receive therethrough and therein fastener bolt means to operatively secure said equipment to said deck.

13. The clamp of claim 12, wherein said axially offset nose tab of said key member is in alignment with one of said vertical flat surfaces of the above-deck body portion.

14. The clamp apparatus of claim 12, further including clamp fastener bolt means for mutual cooperation with said deck clamp's above-deck body portion and with said equipments base attachment flange means.

15. The clamp apparatus of claim 1, further including clamp-fastener bolt-type means for mutual cooperation with said clamp's first body portion and with said equipment base attachment flange means.

16. The clamp of claim 1, wherein said below deck key member is shaped such that said below deck key member's largest cross section perpendicular to said vertical axis is located between said vertically offset arcuate surfaces.

* * * * *